US006269759B1

(12) United States Patent
Zafiroglu et al.

(10) Patent No.: US 6,269,759 B1
(45) Date of Patent: Aug. 7, 2001

(54) APPARATUS FOR PRODUCING A STITCHED PILE SURFACE STRUCTURE

(75) Inventors: Dimitri Peter Zafiroglu, Wilmington, DE (US); Raymond Alan Roe, Chester, VA (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 09/260,442

(22) Filed: Mar. 2, 1999

(51) Int. Cl.[7] ..... D05C 15/16
(52) U.S. Cl. ..... 112/80.01
(58) Field of Search ..... 112/475.23, 80.01, 112/80.32, 80.4, 80.41, 80.5, 80.51, 412, 410, 235

(56) References Cited

U.S. PATENT DOCUMENTS

| | | | | |
|---|---|---|---|---|
| 2,429,281 | * | 10/1947 | Solins | 112/412 X |
| 2,448,928 | | 9/1948 | Stahl . | |
| 3,009,235 | | 11/1961 | De Mestral . | |

(List continued on next page.)

FOREIGN PATENT DOCUMENTS

| | | | |
|---|---|---|---|
| 244 582 | 12/1985 | (DD) . | |
| 3119636 | 5/1981 | (DE) . | |
| 42 28 563 A1 | 8/1992 | (DE) | D04B/21/14 |
| 43 35 109 | 10/1993 | (DE) . | |
| 44 17 692 | 5/1994 | (DE) . | |
| 0 529 575 A2 | 8/1992 | (EP) | B29C/65/40 |
| 0 568 916 A1 | 4/1993 | (EP) | D05C/17/02 |
| 1 427 191 | 5/1973 | (GB) | B32B/5/26 |
| 8-291447 | 4/1995 | (JP) . | |
| WO98/03711 | 1/1998 | (WO) | D04H/11/00 |

OTHER PUBLICATIONS

Malimo®, Sewing–Knitting Machines, Six Parts, discussing Technical Possibilities and Technology.
Mayer, Karl. Tricot Machine pamphlet. Jan. 15, 1997.
Mohawk Commercial Carpet Pamphlet, dated Nov. 1994.
Malimo®, Sewing–Knitting Machines, Six machine types for the manufacture of the most various textile fabric constructions made of fibres and threads. 1974.
Teppich–Wirkmaschine Carpet Knitting Machine, Model 14 125, pamphlet.

*Primary Examiner*—Ismael Izaguirre

(57) ABSTRACT

An apparatus for producing a stitched pile surface structure is disclosed. The apparatus has a plurality of transversely spaced needles forming a needle array, with each needle having a predetermined width dimension (142D). The needles in operation being movable to penetrate a backing at a plurality of needle penetration points as the backing is conveyed along a path of travel through the apparatus. A plurality of laterally adjacent sinker fingers extends forwardly in the direction of travel. Each needle is disposed laterally intermediate adjacent fingers. Each finger has a forward end thereon.

The sinker fingers extend forwardly in the direction of travel past the needle penetration points, the height dimension of at least that portion of each finger that extends forwardly past the needle penetration points being uniform. In addition, the fingers have a base region, with adjacent fingers being spaced from each other by a lateral spacing distance (132) not greater than 1.5 times, and more preferably, not greater than 1.3 times, the predetermined width dimension (142D) of the needle intermediate therebetween.

The height of the fingers is related to the lateral distance between the centers of adjacent fingers.

Each finger may take the form of a fork-like structure having an upper tine and a lower tine.

13 Claims, 10 Drawing Sheets

U.S. PATENT DOCUMENTS

| | | | | |
|---|---|---|---|---|
| 3,109,302 | | 11/1963 | Vitek . | |
| 3,230,917 | | 1/1966 | Wignall et al. . | |
| 3,401,657 | * | 9/1968 | Watkins | 112/80.01 |
| 3,602,011 | | 8/1971 | Kdyne et al. | 66/85 |
| 3,677,206 | | 7/1972 | MacIsaac, Jr. et al. | 112/79 |
| 3,722,442 | | 3/1973 | MacIsaac, Jr. et al. . | |
| 4,103,630 | * | 8/1978 | Wignall | 112/475.23 X |
| 4,192,159 | | 3/1980 | Kohl | 66/203 |
| 4,244,312 | * | 1/1981 | Bialy | 112/235 |
| 4,406,309 | * | 9/1983 | Czelusnizk, Jr. | 112/80.01 X |
| 4,502,902 | | 3/1985 | Zurcher et al. . | |
| 4,818,316 | | 4/1989 | Weinle et al. | 156/88 |
| 4,998,421 | | 3/1991 | Zafiroglu . | |
| 5,470,629 | | 11/1995 | Mokhtar et al. . | |
| 5,472,762 | | 12/1995 | Edwards et al. . | |
| 5,498,459 | | 3/1996 | Mokhtar et al. . | |
| 5,575,228 | * | 11/1996 | Padgett, III et al. | 112/80.41 |
| 5,605,107 | | 2/1997 | Padgett et al. . | |

* cited by examiner

APPARATUS FOR PRODUCING A STITCHED PILE SURFACE STRUCTURE

CROSS-REFERENCE TO RELATED APPLICATIONS

Subject matter disclosed herein is disclosed and claimed in the following copending application:

"Stitched Pile Surface Structure and Process and System for Producing The Same", filed contemporaneously in the names of Dimitri Peter Zafiroglu and Paul Felix Pustolski (RD-7560).

BACKGROUND OF THE INVENTION

1. Field of the Invention

The present invention relates to an apparatus for producing a stitched-bonded pile surface structure.

2. Description of Prior Art

Carpets or velour pile structures formed by tufting machines are well-known. Tufted structures contain tufts in the form of uncut or cut loops inserted into a "primary" backing. A portion of the pile yarn remains on the back face of the backing. The pre-formed tufted backing is then stabilized by applying a relatively heavy layer of adhesive binder material (usually a latex-based material) and, in most cases, a "secondary" backing to the back of the structure. In some cases a layer of thermoplastic material is introduced between the primary and secondary backings to replace the adhesive binder material.

One limitation of these products is that they require relatively heavy primary backings that can hold the tufts securely until the adhesive binder material and secondary backing are applied. A second limitation is that the adhesive binder material and secondary backing add substantial weight. A third limitation is the considerable portion of the tufting yarn is placed under the primary backing, between the primary and secondary backings. This construction leaves the face of the primary backing exposed between tuft-penetration points, requiring a relatively dense pattern of loops or cut-tufts. Furthermore, "tuft-bind," or the force required to pull cut tufts or to unravel uncut loop tufts, is limited, unless a large weight of binder material is used to penetrate the backings and the pile yarn located between the two backings.

—o—0—o—

Flat stitch-bonded structures are also known in the prior art. FIG. 1A is a stylized perspective view of a typical apparatus generally indicated by the reference character 10 for forming a flat, stitch-bonded structure 12 having "laid-in" yarn inlay elements 54 overstitched with a stitching thread. FIGS. 1B and 1C illustrate stylized front and side elevational views of the stitch-bonded structure 12 so produced. It should be noted that in FIGS. 1A through 1C, for purposes of illustration, the yarn 48Y used to form the yarn inlays 54 is shown as being a relatively heavy and bulky yarn of the type typically used to form carpet pile, while the thread 48T (shown in dashed lines in FIG. 1A) used to form the chain stitches 56 is of significantly finer denier.

Each yarn inlay 54 in each of the plural rows of inlays is attached at spaced points to a first, top, surface 14S of a planar backing 14 by the underlap portions 56U of the chain stitches 56. The stitches 56 are linearly interlocked with themselves by overlap portions 56L (FIG. 1B) formed over the second, bottom, surface 14B of the backing 14. A representative stitching apparatus similar in structure and operation to that described herein is manufactured and sold under the Trademark "Malimo" by Karl Mayer Textilmaschinenfabrik GmbH, Obertshausen, Germany.

The stitching apparatus 10 may include a slotted platen 20 that supports the backing 14 along a generally planar path of travel extending longitudinally through the apparatus 10. The slots in the platen 20 are not visible in FIG. 1A. The longitudinal direction of travel of the backing 14, also termed the "machine direction", is indicated by the reference arrow 24. As used throughout this application the longitudinal direction of travel aligns with the longitudinal (or "warp") direction of a pile surface structure being produced, while the direction transverse to the warp direction is termed the "cross", "transverse" or "weft" direction of the pile surface structure being produced.

It is noted that the path of travel of the backing 14 through the apparatus 10 is arbitrarily shown in FIG. 1A as a horizontal path. The backing 14 is supplied to the platen 20 from a suitable supply roll (not shown in FIG. 1A). In the stitch-bonded structure 12 produced by the apparatus of FIG. 1A the backing 14 typically takes the form of a lightly needled staple "fleece", a lightly bonded card web, or a spunlaced sheet. None of these typical backing materials is dimensionally stable. Accordingly, the main purpose of a stitch-bonding operation is to impart stability to the backing 14 in both its longitudinal and cross directions.

The backing 14 is conveyed incrementally in the machine direction 24 by a suitable propelling arrangement, such as a pull roll (not shown in FIG. 1A). Optionally, a hold-down plate downstream of the needle plane may support the backing against the platen in that region. The hold-down plate is omitted from FIG. 1A for clarity of illustration.

At the inlet edge of the platen is a sinker bar 28. The sinker bar 28 extends transversely across the apparatus 10. A plurality of sinker fingers 30 extends forwardly from the sinker bar 28 in the machine direction 24. Each sinker finger 30 is spaced from a laterally adjacent finger 30 by a predetermined lateral spacing 32. The top surface of each sinker finger 30 is indicated by the character 30T, while the undersurface of each sinker finger 30 is indicated by the character 30S. The upper surface 20S of the platen 20 and the undersurface 30S of each sinker finger 30 cooperate to define a throat 34 into which the backing 14 is introduced into the apparatus 10.

A needle bar 40 having a plurality of penetrating needles 42 thereon is mounted beneath the platen 20. Each needle 42 may include a closure (not illustrated). The needle bar 40 is spaced a predetermined distance forwardly of the ends 30E of the sinker fingers 30. The needles 42 extend upwardly through the slots in the platen 20. The needle bar 40 is movable by a suitable actuator (not shown) such that the needles 42 are displaceable in vertically reciprocating fashion in a needle plane 44 located forwardly of the ends 30E of the sinker fingers 30 and normal to the path of travel. Each of the reciprocating needles 42 intersects and penetrates the backing 14 at a respective needle penetration point 46. Each needle penetration point 46 is located in the transverse spacing 32 defined between laterally adjacent sinker fingers 30. The transversely extending line of needle penetration points 46 lies in the needle plane 44.

A plurality of guide bars 50 is mounted above the sinker fingers 30 and above the planar path of travel of the backing 14 through the apparatus 10. Although a typical stitching apparatus may include up to four such guide bars, for clarity of illustration only the guide bars 50T, 50Y are illustrated in FIG. 1A. Each guide bar 50T, 50Y has a plurality of downwardly depending guide elements. The guide elements may be implemented as circular eyelets, as illustrated, or may take the form of tubular members or wide spoon guides, if desired.

The guide elements on the guide bar 50Y serve to carry the yarns 48Y that are laid into the top surface 14S of the backing 14. Each yarn 48Y is dispensed from a beam or from an individual bobbin mounted on a creel rack (not shown in FIG. 1A) and passes through a guide element on the yarn guide bar 50Y. The guide elements on the other guide bar 50T carry the stitching threads 48T that hold the yarns 48Y to the backing 14. Each stitching thread 48T is dispensed from a separate beam or from a bobbin mounted on a creel (not shown in FIG. 1A).

Each guide bar 550Y, 50T is independently movable in various degrees of freedom by a suitable actuating arrangement (not shown). Typically, each guide bar 50Y, 50T may be swung transversely, forwardly, and/or backwardly with respect to any other guide bar. Thus, the yarns 48Y and/or the threads 48T carried on the guide bars 50Y, 50T may be displaced with respect to the backing 14, and/or looped or interlocked with each other in a variety of fashions.

In operation, the backing 14 is introduced from the supply roll into the throat 34 defined between the platen 20 and the sinker fingers 30. The bottom surface 14B of the backing 14 is supported on the platen 20 while the top surface 14S is presented to the undersurface 30S of the sinker fingers 30. The dimension 34T of the throat 34 is larger than the thickness dimension 14T of the backing 14, so that the backing 14 is relatively loosely confined between the sinker fingers 30 and the platen 20 as the backing 14 is advanced along its path of travel through the apparatus 10.

Since the formation of laid-in yarn inlays 54 and the securement of those inlays 54 to the top surface 14S of the backing 14 by the underlaps 56U of the stitches 56 is sufficiently well understood, only a brief description of the process need be described.

The backing 14 is conveyed along the path of travel so that successive transversely extending regions of the backing 14 are advanced into the needle plane 44. Before and after the yarn guide bar 50Y is transversely displaced to dispense the length of yarn that eventually forms the inlay 54 on the surface 14S of the backing 14, stitching threads 48T from adjacent first and second thread guides on the thread guide bar 50T are successively looped around respective first and second locations on the dispensed length of yarn 48Y.

As successive transverse regions of the backing 14 move into the needle plane 44, adjacent first and second needles, e.g., the needles 42-1, 42-2, are actuated and raised through the backing at penetration points 46-1, 46-2, to positions above the path of travel. In the raised positions the adjacent first and second needles 42-1, 42-2 respectively successively engage the looped first and the second stitching threads 48T-1, 48T-2 and draw these stitching threads downwardly toward the backing 14. These actions draw the length of dispensed yarn 48Y to the surface 14S of the backing 14, thereby forming a yarn inlay 54 that extends transversely and diagonally over the first surface 14S of the backing 14. Continued downward movement of each needle 42-1, 42-2 through the backing 14 forms an underlap portion 56U of a chain stitch 56. The underlap portion 56U (FIG. 1B) of the stitch 56 overlies the first surface 14S of the backing 14 and secures the yarn inlay 54 against that first surface 14S. Each stitch 56 also includes an interlockable looped overlap portion 56L that lies against the bottom surface 14B of the backing 14. The arrangement of longitudinally extending overlap portions 56L of the chain stitches 56 on the bottom surface 14B of the backing 14 is best shown in the side elevational view of FIG. 1B.

For each successive longitudinal advance of a region of the backing 14 through the needle plane 44 each needle alternately cooperates with one of its laterally adjacent needles to form a yarn inlay element 54 that extends across the top surface 14S of the backing 14. As a result, as shown in the perspective view of FIG. 1A, the action of the thread guide bars 50T and the needles 42 forms a plurality of lines 58 of interlocked stitches 56, with each stitch 56 including an underlap portion 56U and an overlap portion 56L. Sequential overlap portions 56L interlock with each other, chain-fashion. The stitch lines 58 extend longitudinally in parallel along the backing 14. The frequency of stitches 56 is usually given in units of "courses", which indicate the number of stitches 56 per unit length of stitch line 58. Each stitch line 58 is spaced from an adjacent stitch line 58 by a predetermined stitch spacing, or "wale", W. The distance between longitudinally successive needle penetration points 46 in any given stitch line 58, termed the "stitch length", is indicated by the reference character "S".

Each yarn inlay 54 has a generally U-shaped configuration comprising a root portion 60 (FIG. 1C) with two branches 60B extending therefrom. The root portion 60 of the inlay 54 is held against the surface 14S of the backing 14 by the underlap portion 56U of a stitch 56. Each branch of a given yarn inlay 54 in one row is joined to a branch 60B of a yarn inlay 54 in an adjacent row to define a zig-zag array of inlays 54 on the top surface 14S of the backing 14. In the terminology of the art this arrangement of inlays 54 and stitching thread underlaps 56U may be identified as a reciprocating 0-0/2-2 stitch, or "tricot" stitch. "Laid Atlas" stitches such as 0-0/2-2/2-2/4-4 4-4/2-2/2-2/0-0, or longer laid stitches such as 0-0/3-3 or 0-0/4-4, may also be used.

As is seen in the front elevational view of FIG. 1C each yarn inlay 54 is substantially flat, that is, it lays directly against the first surface of the backing. The height of any vertical clearance, or gap (if one is present) between the yarn inlay 54 and the first surface 14 of the backing 12 is diagrammatically indicated in FIG. 1C by the reference character "h". In prior art laid-in stitch bonded structures the ratio h/W is substantially equal to zero.

—o—0—o—

In another well-known form of yarn structure 12' (FIG. 2A) the yarn 48Y is stitched into a backing 14 that is dimensionally stable in both its longitudinal and cross directions without the use of an overstitching thread. This form of stitched-in structure is typically used for towels, insulation structures, and wall coverings. FIG. 2A is a perspective view of an apparatus 10' used to produce this form of stitched-in yarn structure 12'. A commercially available apparatus similar in structure and operation to that described in connection with FIG. 2A is manufactured and sold under the Trademark "Malipol" by Karl Mayer Textilmaschinenfabrik GmbH, Obertshausen, Germany. Except for the distinctions to be noted the apparatus 10' is substantially identical to the prior art stitching apparatus 10 shown in FIG. 1A. Accordingly, identical reference characters are used for identical structural elements, while modified elements or modified structural relationships will be indicated by single primed reference characters.

One difference between the apparatus 10 of FIG. 1A and the apparatus 10' of FIG. 2A lies in the structure of the sinker fingers 30' and their disposition with respect to the needle penetration points 46. In the apparatus 10' the sinker fingers 30' extend forwardly (in the machine direction 24) beyond the needle penetration points 46. In addition, the portion of the fingers 30' forward of the needle penetration points 46 taper downwardly toward the backing 14. Since an over-stitching thread 48T is not used since the apparatus 10' requires only the yarn guide bar 50Y.

In operation, a given yarn 48Y is engaged by adjacent needles 42 to form yarn elements 54' that are stitched-into the backing 14. A basic tricot stitch, such as a 1-0/1-2 stitch across two stitch rows, is typically formed. As the yarn 48Y is drawn by the needles toward the backing 14 the extension of the sinker finger 30' past the needle penetration points 46 prevents the yarn elements 54' from being drawn flat against the top surface 14T of the backing 14. Thus, each yarn element 54' exhibits an inverted loop portion 60L' that overlies the top surface 14S of the backing 14. As is illustrated in FIGS. 2A and 2B interlocking chain overlaps 56L' are formed adjacent the second (bottom) surface 14B of the backing 14. The loop portion 60L' of each yarn element 54' emanates from the needle penetration point 46, imparting a generally V-shaped configuration to the yarn element 54' in the vicinity of the surface 14S. Owing to the forward taper of the sinker fingers 30', as the backing 14 is advanced in the machine direction 24, the loop portions 60L' of the yarn elements 54' are easily doffed from the fingers.

The vertical clearance between the looped yarn element 54' and the top surface 14S of the backing 14 is again diagrammatically indicated in FIG. 2C by the reference character "h", while the spacing between adjacent longitudinally extending stitch lines 58' is again indicated by the reference character W. The apparatus 10' produces a pile structure 12' in which the ratio h/W of the loop height h to the stitch spacing W is substantially greater than zero.

—o—0—o—

Loop yarn structures 12" may also be formed using an array 16 of cross-laid weft-inserted yarns in lieu of a dimensionally stable backing. FIG. 3A illustrates a prior art apparatus 10" for forming this type of yarn structure 12". As is the case for the other illustrated prior art apparatus identical reference characters are used for identical structural elements, while modified structural elements or modified structural relationships will be distinguished by double primed reference characters.

Similar to the arrangement of FIG. 2A the apparatus 10" includes forwardly extending sinker fingers 30". The portion of the fingers 30" that extend forwardly past the needle penetration points 46 may have a substantially uniform height dimension 30H". As is the case for the arrangement of FIG. 1A the apparatus 10" includes both a yarn guide bar 50Y and a thread guide bar 50T.

The presence of the extending fingers 30" forms each yarn element 54" having an elevated pile loop 60L". As seen in FIGS. 3A and 3B the U-shaped root portion 60" of each yarn element 54" in each row of elements is secured to the weft yarns in the array 16 by an underlap 56U" of stitching thread. The point of contact between a weft yarn 16 and an underlap 56U" is indicated by the character 56M". The stitching threads 48T" are longitudinally interlocked by chained overlap portions 56L" that extend under the weft yarns 16. Adjacent stitch lines 58" are spaced transversely by the distance W. When only weft-inserted yarns are used the yarn elements 54" so formed tend to pull the stitching thread 48T and weft yarn 16, causing them to deflect upwardly in the lateral spacing 32" between the adjacent sinker fingers 30", as shown in FIG. 3C. Each loop portion 60L" of each yarn element 54" has a height dimension h, as measured from a reference plane P containing contact points 56M", thus imparting to the yarn structure 12" a h/W ratio greater than zero.

A commercially available apparatus similar in structure and operation to that described in connection with FIG. 3A is manufactured and sold under the Trademark "Schusspol" by Karl Mayer Textilmaschinenfabrik GmbH, Obertshausen, Germany. Variations of such apparatus utilizing pre-formed backings have also been suggested in German Democratic Republic Patent 244,582 (VEB Kombinat Textima). The difficulties in penetrating such backings with large amounts of binder to secure the pile loops onto the backing have culminated in using self-formed weft-inserted open backings as in the product produced by the apparatus of FIG. 3A, in preference to pre-formed, pre-stabilized backings.

—o—0—o—

Also known in the art are various knitting apparatus. One example of such apparatus is manufactured and sold under the Trademark "HKS 4-1" by Karl Mayer Textilmaschinenfabrik GmbH, Obertshausen, Germany. This apparatus is similar to that described in connection with FIG. 2A in that it has tapered sinker fingers that extend forwardly in the machine direction past the needle penetration points. However, in place of a backing that is dimensionally stable in both its length and width directions, the knitting apparatus also forms, in situ, a planar array of tricot stitch underlaps or weft-inserted yarns, similar to that shown in FIG. 3A. The pile yarns are usually knitted-in, with substantial amounts of yarn located below the planar array.

Products such as carpets, velours or velvets can be produced by similar machinery. These products require high stability against surface wear. Therefore, large amounts of binder material are applied from the backside of the structure to stabilize and reinforce the product. Representative of such knit pile structures are the commercial carpets manufactured using a "woven interlock construction" and sold by Mohawk Carpets, Inc., Calhoun, Ga.

FIG. 4 is a stylized front elevation view of a knit pile structure $\mathbf{12}^3$ having yarn element $\mathbf{54}^3$ with an elevated stitched-in pile loop $\mathbf{60}L^3$. The root portion $\mathbf{60}^3$ of each stitched-in pile yarn element $\mathbf{54}^3$ is additionally secured by an underlap $\mathbf{56}U^3$ of a stitch 56 to the weft yarns $\mathbf{16}^3$ that form a backing $\mathbf{14}^3$. The stitches 56 are longitudinally interlocked by chained overlap portions $\mathbf{56}L^3$ that extend under the weft yarns $\mathbf{16}^3$.

A longitudinally extending yarn 59 may be laid over the root portion $\mathbf{60}^3$ of each yarn element $\mathbf{54}^3$ in each stitch line $\mathbf{58}^3$ and is there held by an underlap $\mathbf{56}U^3$ of the stitch 56. A second longitudinally extending yarn 61 is laid under the weft yarn $\mathbf{16}^3$ that and is there held by an overlap $\mathbf{56}L^3$. The yarns 59 and 61 usually serve the purpose of filling or reinforcing the structure. In addition, a planar layer of weft-extending or laid-in yarns 62, 63 are held by the underlaps $\mathbf{56}U^3$ and the overlap portions $\mathbf{56}L^3$ of the stitches 56. These yarns 62, 63 also serve to reinforce the yarn structure $\mathbf{12}^3$.

—o—0—o—

Each of the above-described known apparatus and processes have attendant disadvantages that are believed to detract from their utility in forming pile surface structures.

For example, the laid-in stitch-bonded structure produced by the apparatus of FIG. 1A is flat, has no pile height, and thus would be disadvantageous for use as a carpet because of the lack of cushion. Stabilization and reinforcement by applying binder from the back to qualify the product as a floor covering would penetrate into the entire length of the laid-in yarns and would stiffen the face yarns, rendering the surface of the product unattractive and harsh.

The apparatus of FIG. 2A is efficient and fast in operation, and the product produced is relatively easy to stabilize and reinforce by the addition of binder material to the back face to secure the overlaps of the pile yarns. Nevertheless, the pile yarn structure produced is believed to exhibit several disadvantages. The loops tend to lean forwardly because of the pull against the interlooped overlaps, and a very large amount of pile yarn is wasted under the backing in the form of chain stitch overlaps. Moreover, the taper of the sinker fingers downstream of the needle penetration plane causes the formed loops to be pulled and shortened, resulting in much lower loop height h as compared to the height of the sinker finger at the needle penetration plane. In addition, the pile loops 60L (FIG. 2C) emerge from a single, highly constricted, needle penetration opening in the backing, thus defining a "V-shape" rather than a "U-shape", thereby minimizing the coverage of the upper surface of the backing by the pile loop.

In the pile structure formed using the apparatus of FIG. 3A the weft-inserted yarns in the array tend to deflect upwardly between the two sinker elements, as shown in FIG. 3C. This has the effect of shortening the pile height. Furthermore, the stitching thread must pull and slide and fully surround two relatively loose yarns (pile and weft) and therefore it must be drawn very tightly. This slows down the process and limits the overall tightness that can be obtained. Moreover, the product is dimensionally unstable because of the absence of multidimensional ties in the backing layer, unless large amounts of adhesive binder are applied through all lower elements to stabilize the structure. Applying large amounts of binder from the back does not necessarily reach the roots of the U-shaped pile yarns to secure all filaments of the pile yarns. Relatively tight chain stitches exacerbate this problem since they tend to limit the propagation of liquid binder into the filaments of the pile yarn in the vicinity of the constricted roots. Converting the system of FIG. 3A into one utilizing a pre-formed stable backing has, to date, caused even more serious problems with sufficient binder penetration to the pile yarns through the backing, and also difficulties in obtaining sufficiently tight chain stitch overlaps to securely hold the pile yarns in place.

In the knit pile structure of FIG. 4 the pile emerges in a "V-shape" rather than a "U-shape", again minimizing the coverage of the upper surface of the backing. Relatively large amounts of pile yarn are consumed in forming the back face of the structure. Although the structure does allow the propagation liquid binder into the roots of the pile elements, relatively large amounts of binder are required to dimensionally stabilize the structure.

—o—0—o—

In view of the foregoing it is believed desirable to construct a pile surface structure over a prefabricated or in-situ-formed backing held under tight control, with all of the pile loop yarns located over the upper surface of the backing. It is also believed desirable to attach the pile elements to the backing with separate but tight underlaps of finer stitching thread, and to further secure the pile elements with binder primarily concentrated in the tightly constricted roots of the pile yarns. As a result a lightweight, stable and fully erect pile structure, providing maximum pile yarn coverage over the backing is produced.

SUMMARY OF THE INVENTION

The stitching apparatus in accordance with the present invention has a plurality of transversely spaced needles, each having a predetermined width dimension (142D). The needles penetrate the backing as it is conveyed through the apparatus at a plurality of needle penetration points. Each needle is disposed laterally intermediate a pair of laterally adjacent sinker fingers. Each finger extends forwardly past the needle penetration points.

In accordance with this invention adjacent fingers are spaced from each other by a lateral spacing distance (132) that is not greater than 1.5 times the predetermined width dimension (142D) of the needle intermediate therebetween. More preferably, the lateral spacing distance (132) is not greater than 1.3 times the predetermined width dimension (142D) of the needle.

At least that portion of each finger that extends forwardly past the needle penetration points has a uniform height dimension H. The height of the finger is related to the distance between the centers of adjacent fingers. The height of the sinker finger should be at least one-half times the distance between the centers of adjacent fingers. More preferably, the height of the sinker finger should be at least equal to the distance between the centers of adjacent fingers. Most preferably the height of the sinker finger should be at least equal to twice the distance between the centers of adjacent fingers.

Each finger may take the form of a fork-like structure having an upper tine and a lower tine.

DESCRIPTION OF THE DRAWINGS

The invention will be more fully understood from the following detailed description, taken in connection with the accompanying drawings, which form a part of this application and in which:

FIG. 1A is a stylized perspective view of an apparatus for forming a laid-in stitch-bonded structure of the prior art produced by the apparatus of FIG. 1A; while

FIG. 2A is a stylized perspective view, similar to FIG. 1A, of an apparatus for forming a stitch-bonded structure of the prior art; while

FIG. 3A is a stylized perspective view, similar to FIG. 1A, of an apparatus for forming another stitch-bonded structure of the prior art; while

DESCRIPTION OF PREFERRED EMBODIMENT

Figure 1A:
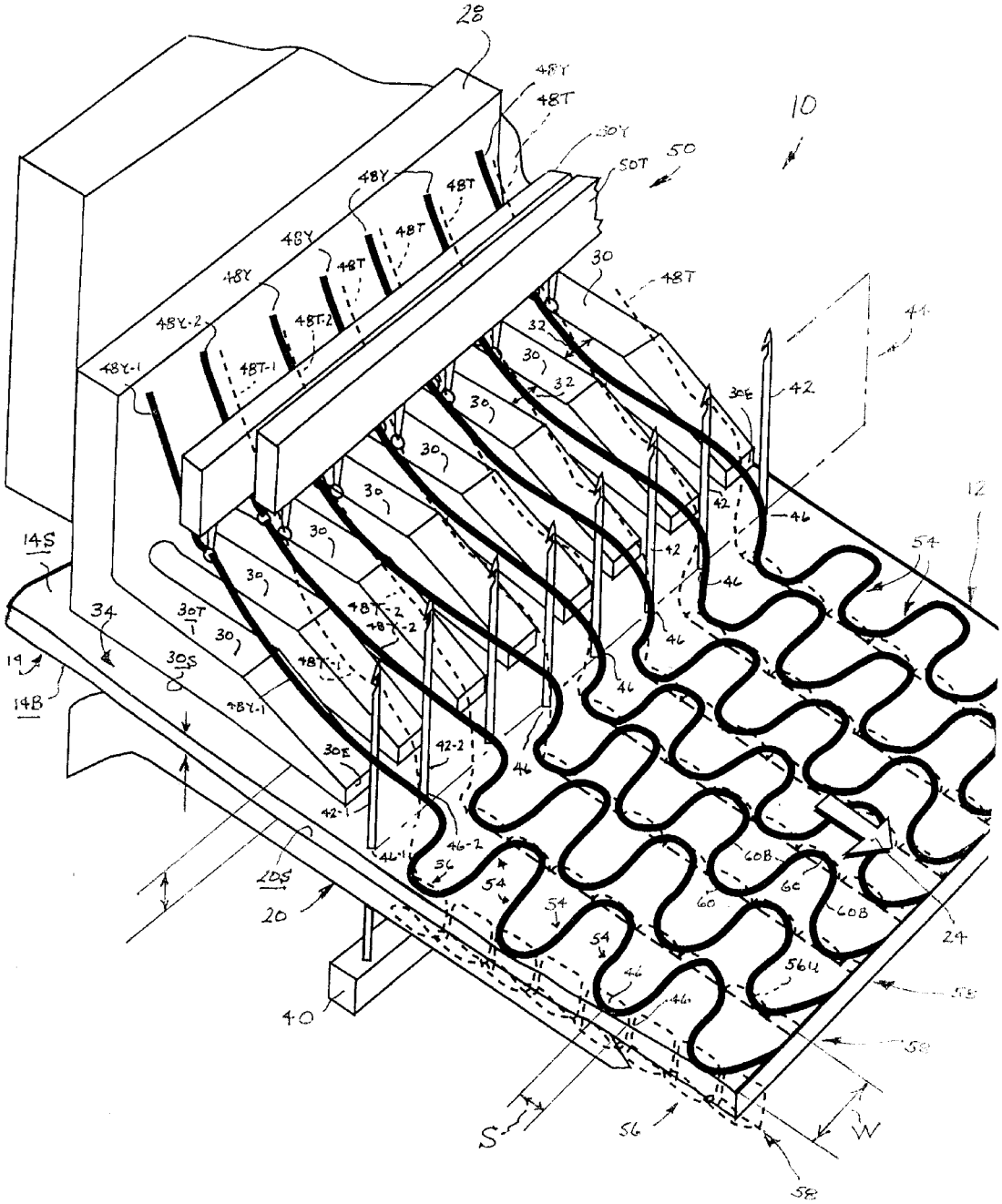
Figure 1A Prior Art
Figure 1B:
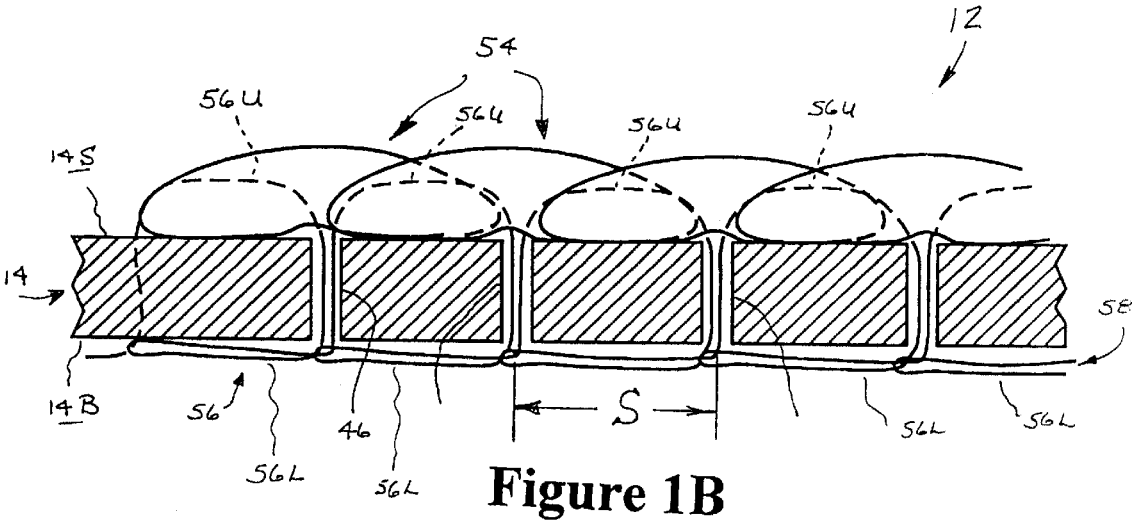
Figure 1B Prior Art
FIGS. 1B and 1C are side and front elevational views, respectively, of the laid-in stitch-bonded structure of the prior art produced by the apparatus of FIG. 1A.
Figure 1C:
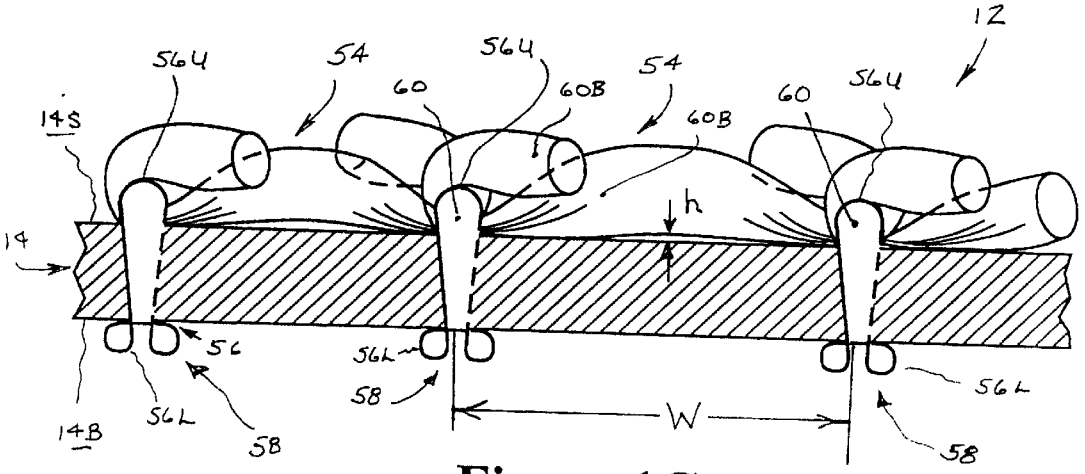
Figure 1C Prior Art
Figure 2A:
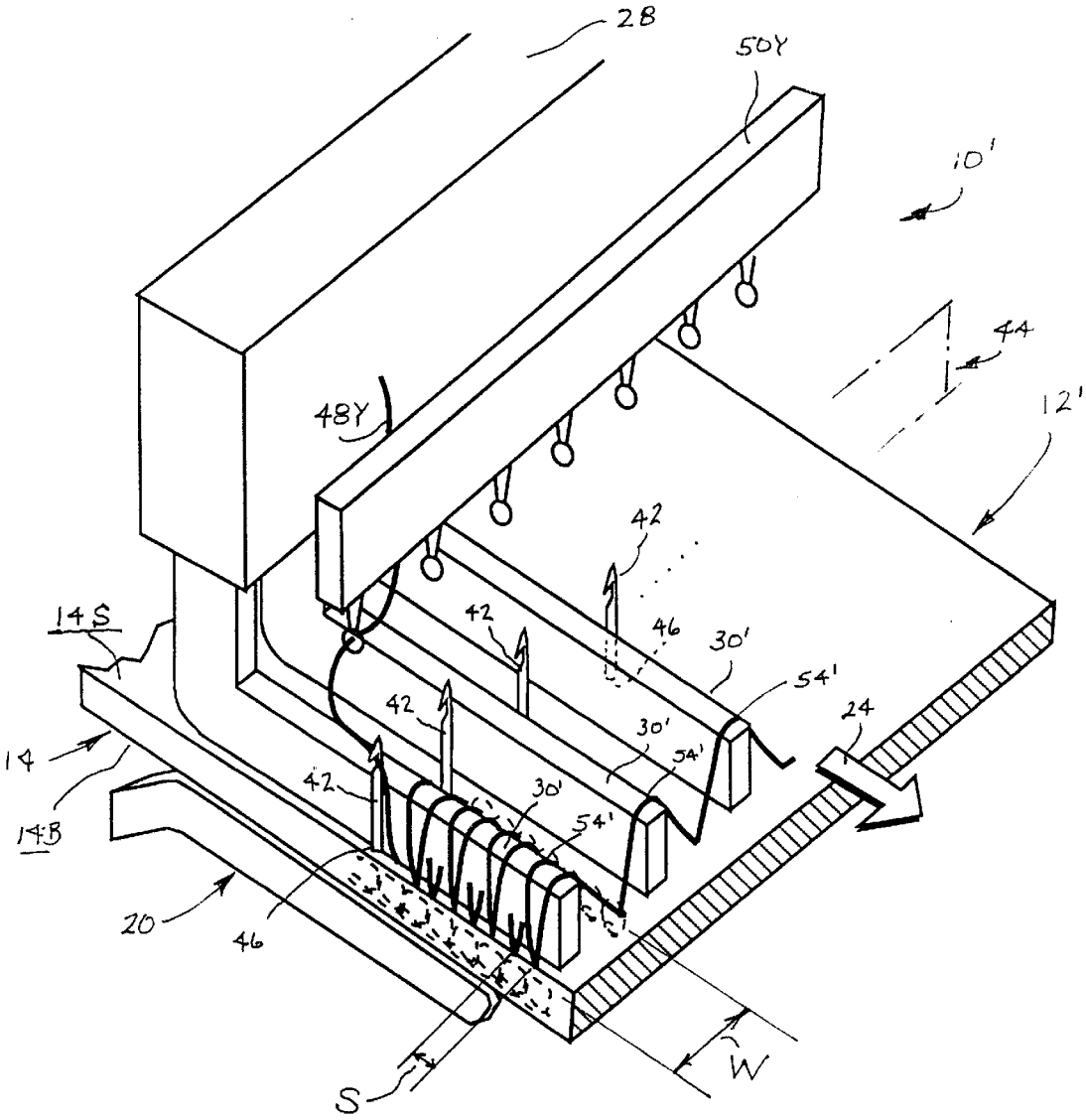
Figure 2A Prior Art
Figure 2B:
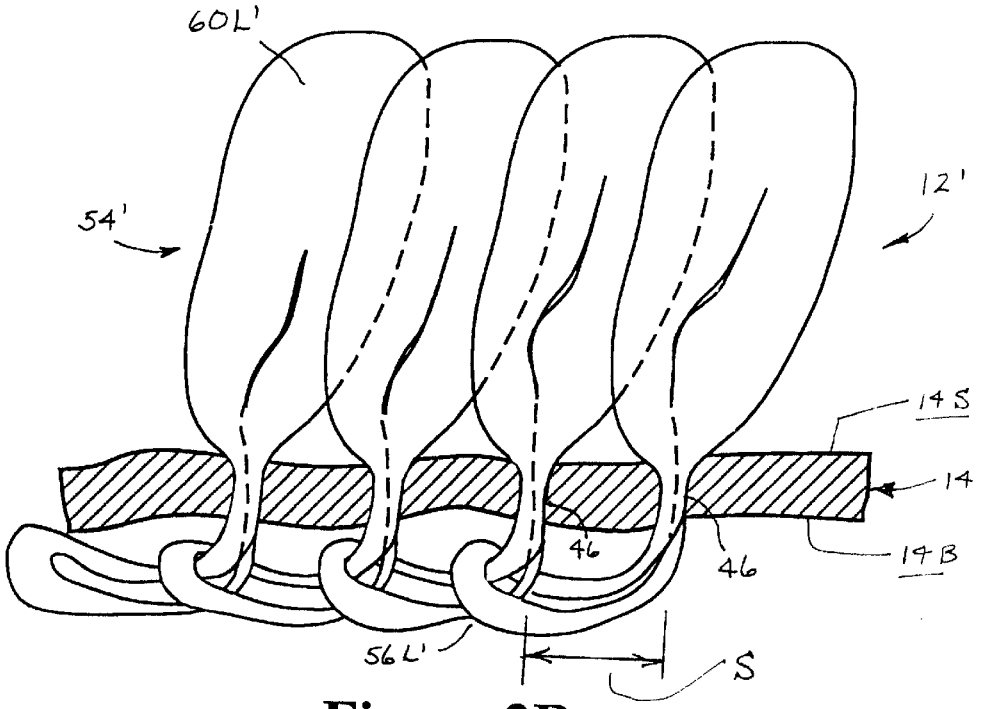
Figure 2B Prior Art
FIGS. 2B and 2C are side and front elevational views, respectively, of the stitch-bonded structure of the prior art produced by the apparatus of FIG. 2A.
Figure 2C:
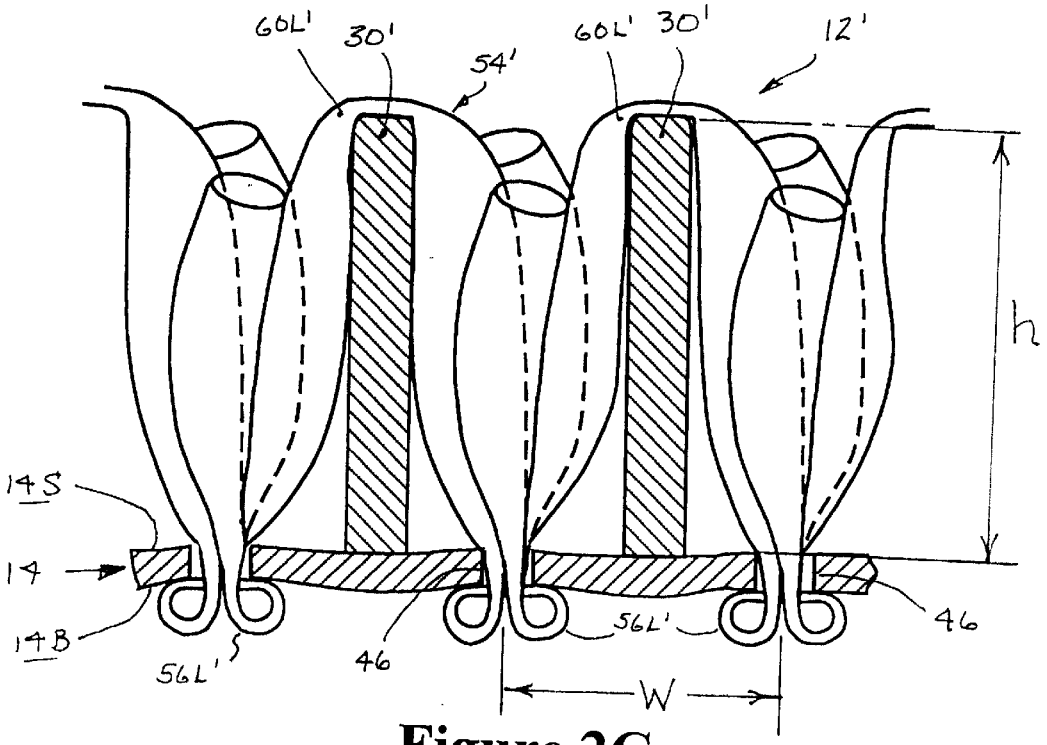
Figure 2C Prior Art

Throughout the following detailed description similar reference numerals refer to similar elements in all figures of the drawings.

Figure 3A:
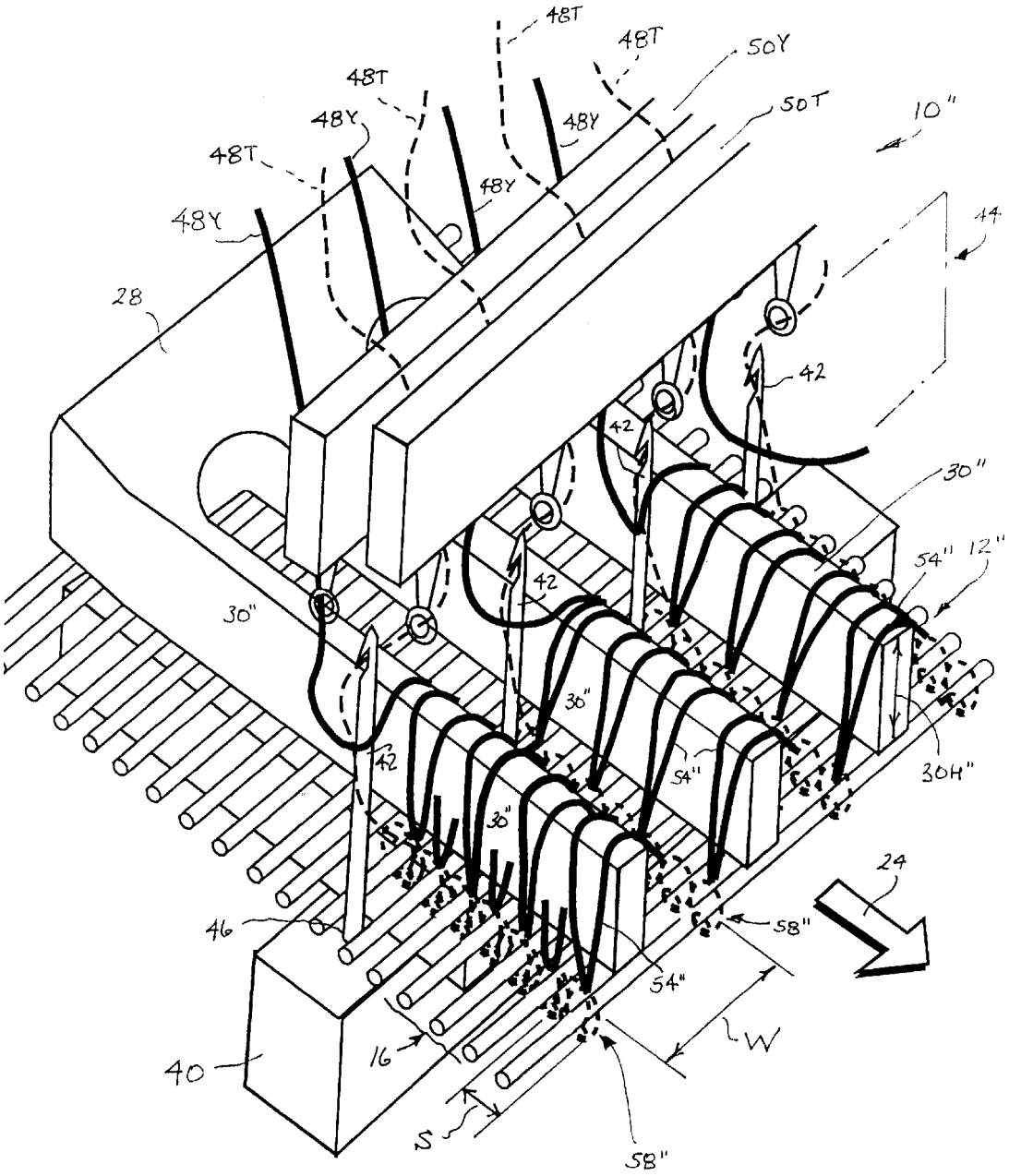
Figure 3A Prior Art
Figure 3B:
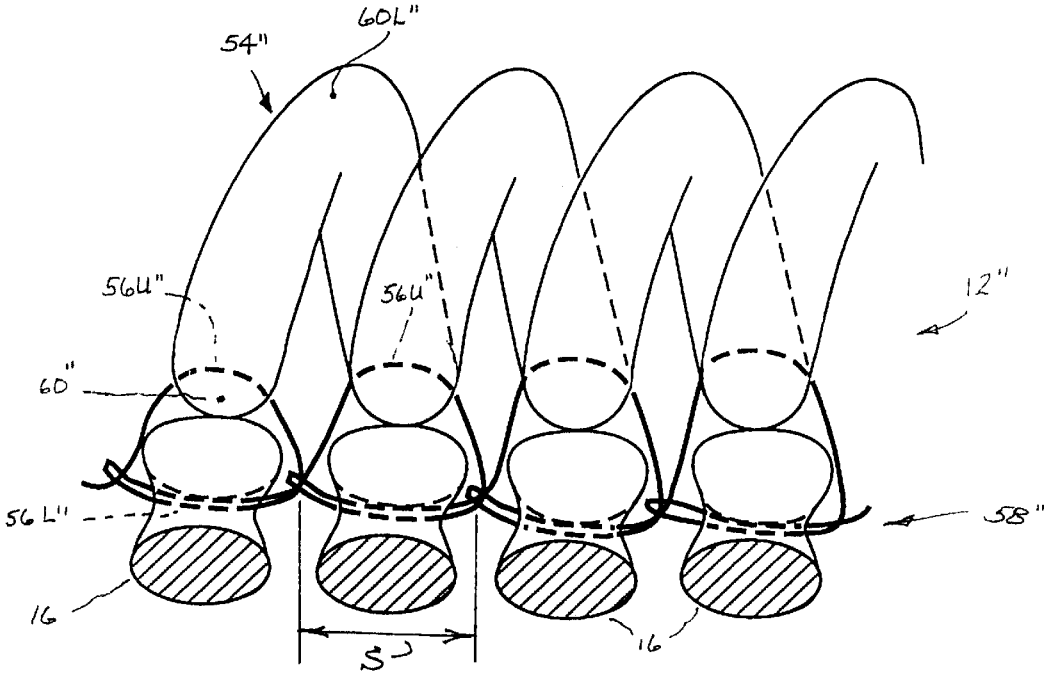
Figure 3B Prior Art
FIGS. 3B and 3C are side and front elevational views, respectively, of the stitch-bonded structure of the prior art produced by the apparatus of FIG. 3A.
Figure 3C:
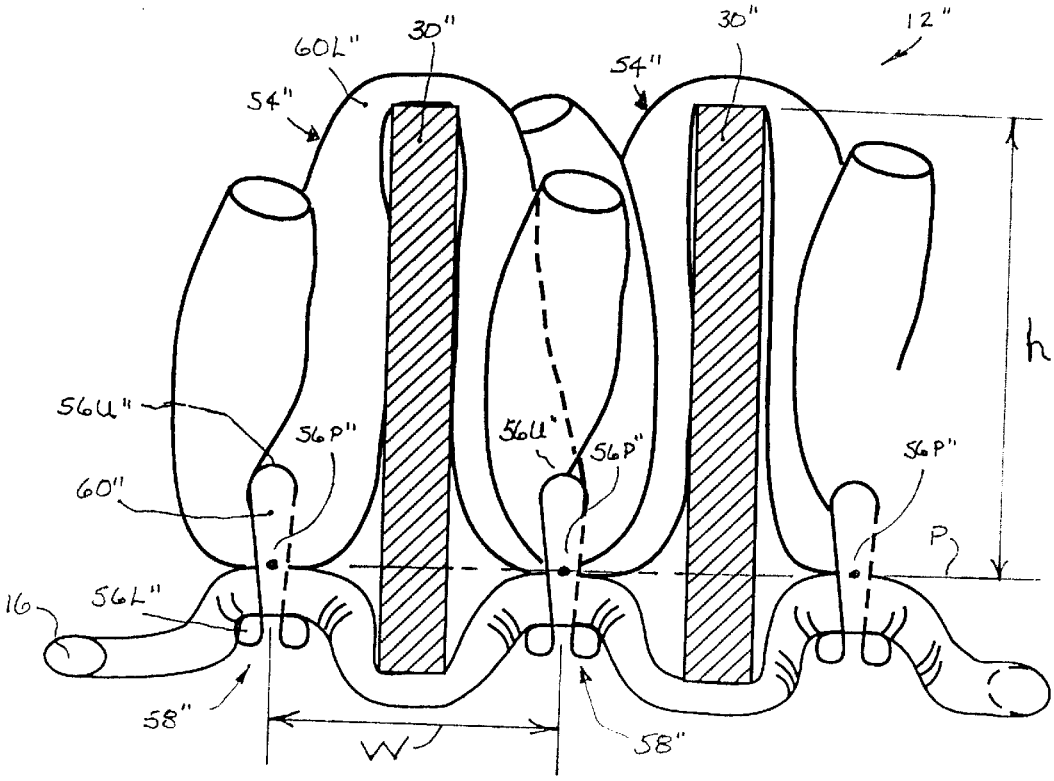
Figure 3C Prior Art
Figure 4:
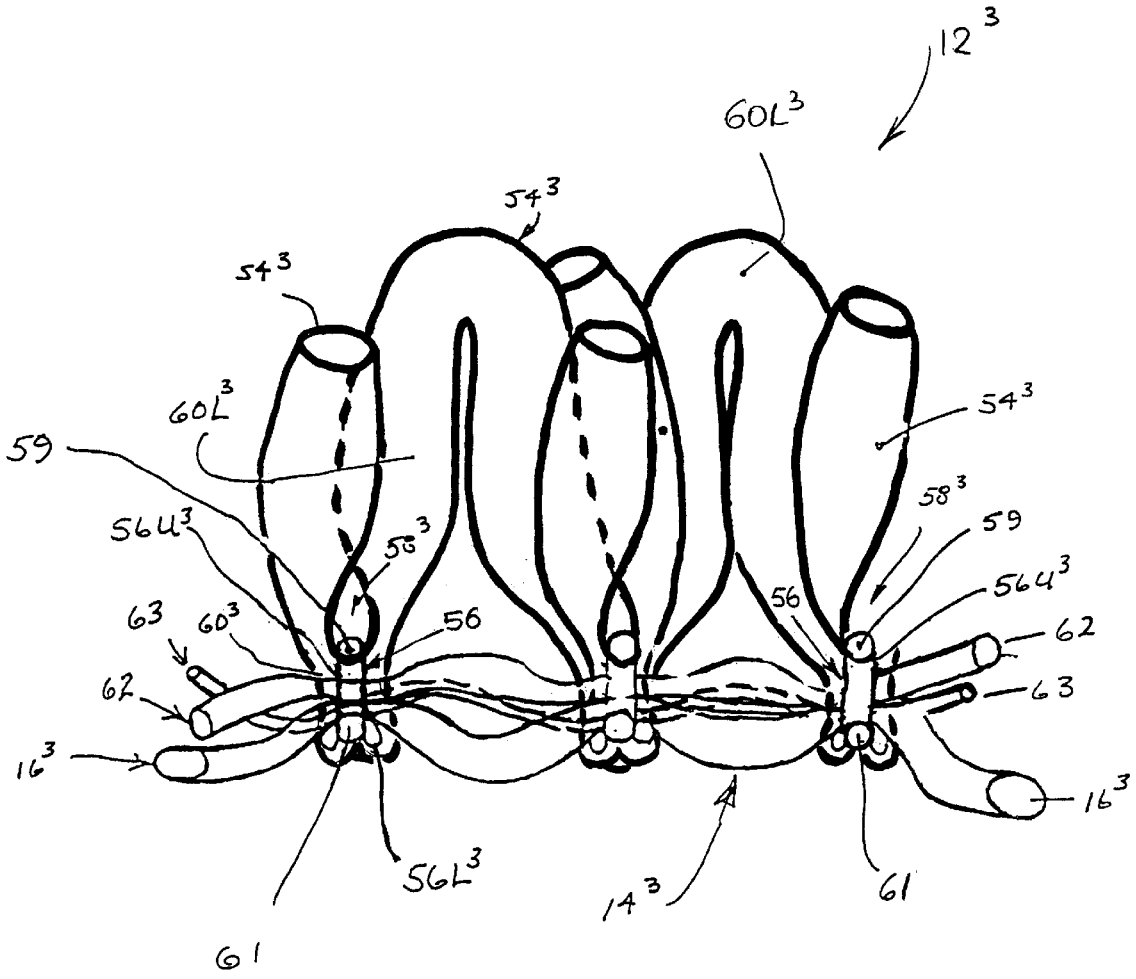
Figure 4 Prior Art
FIG. 4 is a front elevational view of a knit structure of the prior art.
Figure 5A:
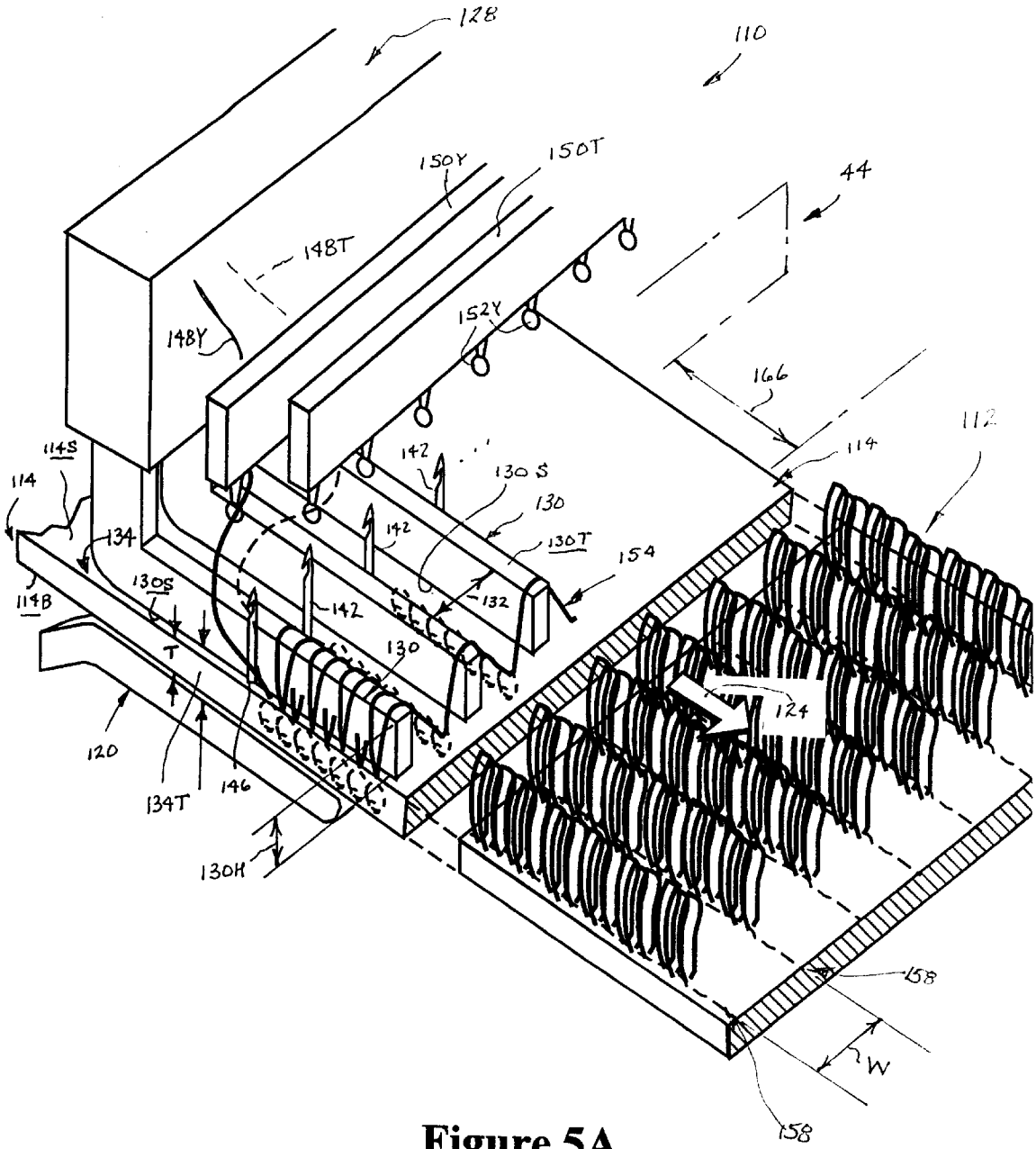
FIG. 5A is a stylized perspective view of an apparatus for producing a laid-in stitch-bonded pile surface structure in accordance with the present invention.

FIG. 5A is a stylized perspective view of the basic embodiment of the stitching apparatus 110. The stitching apparatus 110 shown in FIG. 5A is an amalgamation of certain structural and functional features found in the prior art stitching apparatus 10 and 10", respectively shown in FIGS. 1A and 3A, but which includes modifications in certain areas to produce the pile surface structure 112 of the present invention. Accordingly, where appropriate throughout this discussion of the present invention, structural and functional elements and/or relationships of the stitching apparatus 110 that are similar to elements and relationships in the apparatus discussed earlier will be indicated by reference numerals beginning with the digit "1" followed by the appropriate corresponding basic two-digit reference numeral earlier used to identify the similar element or relationship. In addition, where appropriate, structural and functional elements and/or relationships present in the pile surface structure 112 of the present invention that are similar to elements and relationships found in structures discussed in connection with earlier FIGS. 1A through 3A will be numbered using the same convention. Newly introduced structural or functional elements or relationships found in both the apparatus and the pile surface structure will be indicated by a reference numeral that should have no counterpart in the previous Figures.

The stitching apparatus 110 preferably includes a slotted platen 120 that supports a backing 114 as the same is incrementally advanced along a generally planar path of travel extending longitudinally in the machine direction 124 through the apparatus 100. The path of travel through the stitching apparatus 110 is again arbitrarily shown as a horizontal path. The backing 114 is supplied to the stitching apparatus 110 from a supply roll 104 (FIG. 5).

As a general proposition the backing 114 is preferably a pre-fabricated member, that is formed prior to its insertion into the apparatus 110. The pre-fabricated backing 114 is made of a material that is dimensionally stable in both its longitudinal (warp) and transverse (weft) directions. The backing 114 has a first, top, surface 114S and a second, bottom, surface 114B, and a basic thickness dimension T. The basic thickness dimension T is measured with substantially no applied pressure to the backing 114. Preferred materials for a pre-fabricated backing include any dimensionally stable sheet material onto which a stitch can be attached without tearing or deforming the backing. Knits, nonwovens, films, woven filament fabrics, woven split film sheets, or any stabilized fibrous sheet are suitable. The backing must have sufficient dimensional stability and sufficient resistance to out-of-plane deflection to avoid deformation during feeding and to resist excessive upward deflection as the needles penetrate it and as the loops pull it after formation. Bonded-staple or continuous-filament nonwovens with a weight range between thirty (30) and one hundred twenty (120) gms/sq.m. are preferred. The material of preference is polyester because it is believed to offer the best balance of dimensional stability vs. temperature, moisture, and cost.

However, as will be developed, in some implementations the backing 114 may be formed in-situ by the apparatus 110 simultaneously with the formation of the pile surface structure. Such a backing could be formed using an array of weft-extending yarns, similar to the structure of FIG. 3A.

A sinker bar 128 extends transversely across the stitching apparatus 110. A plurality of sinker fingers 130 extends forwardly from the sinker bar 128 in the machine direction 124. The top surface of each sinker finger 130 is indicated by the character 130T, while the undersurface of a finger 130 is indicated by the character 130S. The top surface 130T of each finger 130 is preferably smooth and polished to facilitate yarn movement and the formation of pile loops, as will be described. A rounded-corner cross-section at the edges of the top surface 130T is preferred. The upper surface 120S of the platen 120 and the undersurface 130S of each of the sinker fingers 130 defines a throat 134 into which the backing 114 is introduced into the stitching apparatus 110.

The sinker fingers 130 are transversely sized or configured, at least in the vicinity of their base region 130B, such that a predetermined close lateral spacing 132 (FIG. 5C) is defined between adjacent fingers 130. In the embodiment illustrated each finger 130 flares at its base 130 toward each adjacent finger. It should be appreciated, alternatively, that a finger 130 may be configured to exhibit the same transverse dimension throughout its height.

Figure 5B:
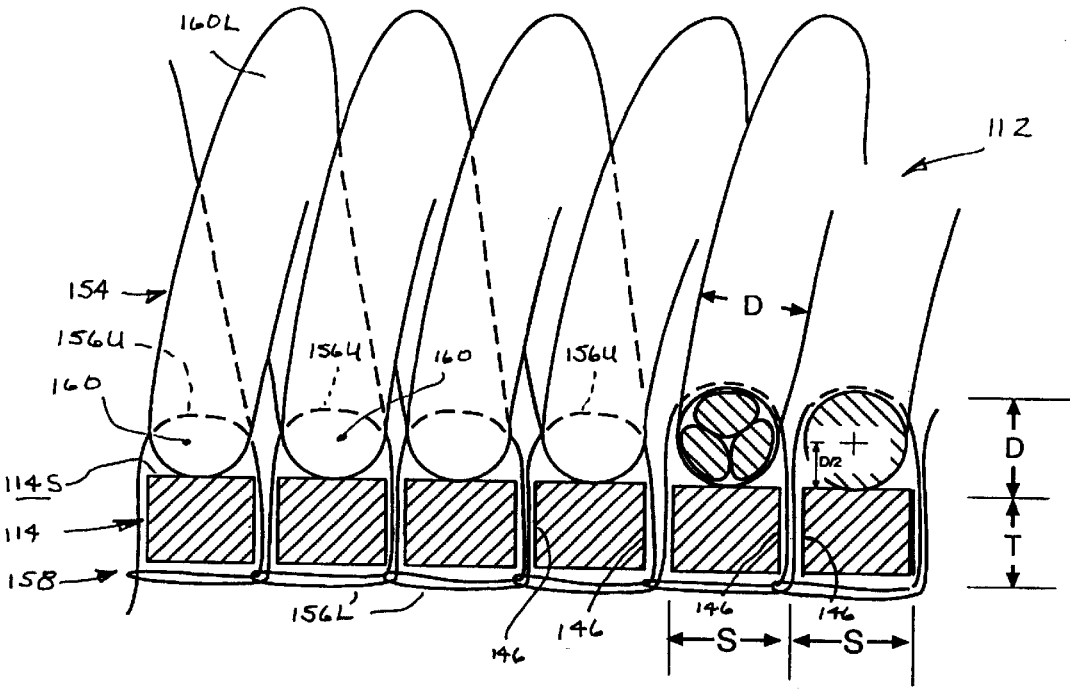
FIGS. 5B and 5C are side and front elevational views, respectively, of the laid-in stitch-bonded pile surface structure produced by the apparatus of FIG. 5A.

A needle bar (not shown) having a plurality of hooked penetrating needles 142 thereon is mounted beneath the platen 120. The needles are transversely spaced by the stitch spacing distance W. Each needle 142 has a predetermined width dimension 142D. The needles 142 extend upwardly through the platen 120. The needles 142 are displaceable in vertically reciprocating fashion in a needle plane 144. The transverse line of needle penetration points 146 lies in the needle plane 144. Each of the reciprocating needles 142 intersects and penetrates the backing 114 at a respective needle penetration point 146 located transversely between the sinker fingers 130 (i. e., in the spacing 132 defined laterally between adjacent fingers). In the pile surface structure 112 each stitch has a "stitch length" indicated by the reference character "S" (FIG. 5B). The "stitch length" denotes the distance between longitudinally successive needle penetration points 146 in any given stitch line 158.

Figure 5C:
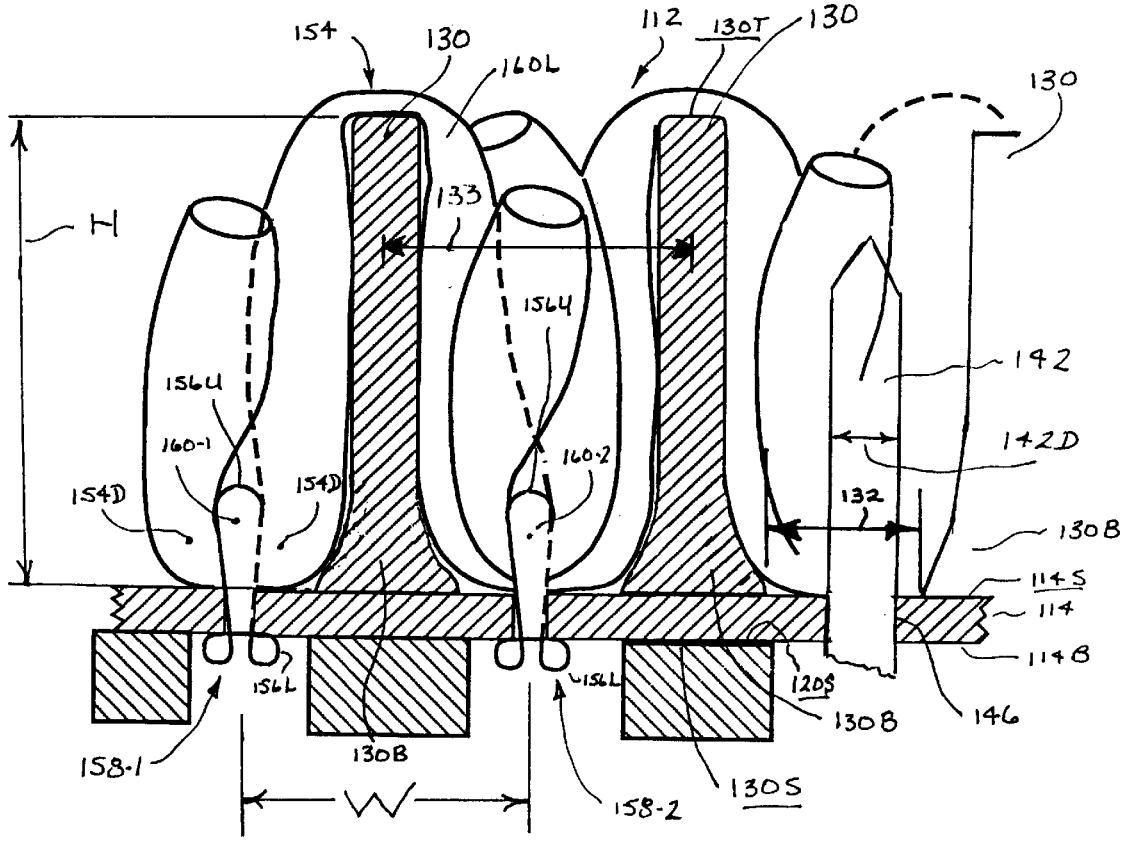

As is perhaps best illustrated in FIG. 5C the lateral spacing 132 between adjacent fingers 130 is sized to permit only the needle 142 and the stitching threads drawn by that needle to pass relatively freely in the vertical direction. The close spacing 132 of adjacent fingers 130 has the beneficial advantage of preventing upward deflection of the backing 114 as the needle 142 moves upwardly through the same. The transverse spacing 132 is about 1.2 to about 1.5 times the width dimension 142D of the needle 142. Preferably, the transverse spacing 132 should not be greater than about 1.5 times the width dimension 142D, and more preferably, not greater than 1.3 times the width dimension 142D.

Guide bars 150T, 150Y are mounted above the sinker fingers 130 and above the planar path of travel of the backing 114. Guide elements 152Y on the guide bar 150Y serve to carry the pile yarns 148Y that are laid into the top surface 114S of the backing 114, while the guide elements 152T on the guide bar 150T carry the stitching threads 148T that hold the pile elements 154 formed by the yarns 148Y to the top surface 114S of the backing 114. The supply creel for the pile yarns 148Y supplied to the guide bar 150Y is indicated in FIG. 5 by the reference character 105Y. The pile yarns may alternatively be supplied to the apparatus 110 from a beam 105Y'.

The pile yarns 148Y used to form the pile elements 154 of the present invention are multi-filamentary single-end yarns that have a diameter generally indicated by the reference character "D", as measured in the free (non-compressed, non-stretched) state. Alternatively, a multi-end yarn formed as a combination of several multi-filamentary single-end yarns may be used as the pile yarn 148Y. The "effective diameter" of the multi-end yarn is also indicated by the reference character "D". The "effective diameter" of the multi-end yarn is also the diameter as measured in its free (non-compressed, non-stretched) state.

A very wide selection of yarns may be used for the pile yarns 148Y, depending upon use and need. Preferred pile yarns are higher-melting temperature yarns such as aramid, nylon or polyester yarn. Heavy and bulky yarns, whether single-end yarn or as multi-end yarn, having a denier in the range from about five hundred to about ten thousand dtex (500–10,000 dtex) are suitable for carpets. Finer yarns, having a denier in the range from about two hundred to about one thousand dtex (200–1,000 dtex) are more suitable for velour fabrics. If a multi-end yarn is used the diameter D refers to the "effective diameter" of the multi-end yarn. For coverage considerations the diameter (or effective diameter) D of the pile yarn should be the same or slightly larger than the stitch length S. Heavier or multi-end yarns provide proportionally higher surface coverage, allowing the use of lower stitching densities, and higher stitching speeds.

For the pile surface structure 112 the total pile yarn weight ("G") ranges from approximately one hundred to twenty-five hundred (100 to 2,500) grams per square meter. One of the fundamental practical advantages of the present invention is that it allows the formation of pile surface structures with very low pile yarn weight and good face coverage of the backing.

It should be appreciated that although only a single guide bar 148Y is shown in the Figures, pile-forming yarns may originate from more than one guide bar, and may have any suitable pattern to create special aesthetics. Yarn tension and yarn consumption may be varied from bar to bar (and from yarn to yarn within the bar), even if all bars use the same or identical-but-opposing stitch pattern. The denier and/or tension of yarns in different bars or wales may also be different, creating a "sculpted" effect.

The stitching thread 148T is normally supplied to the guide bar 150T from a supply beam 105T (FIG. 5). The stitching thread 148T is, in the general case, preferably made of a high-tenacity, fully-set moisture and temperature-stable thermoplastic material. Generally speaking, the denier of the stitching thread 148T is less than one-half the denier of the pile yarns. Preferably, the stitching thread has a denier less than about one-third (⅓) the denier of the pile yarn. Thus, the stitching thread has a denier in the range from about one hundred to about one thousand dtex (100–1,000 dtex). Generally speaking, the material of choice is polyester. Partially oriented shrinkable thermoplastic threads can also be used to advantage, as will be explained hereafter.

In the apparatus 110 the sinker fingers 130 are elongated members sized to extend in the direction of travel 124 forwardly beyond the line of needle penetration points 146 for a predetermined distance 166. As will be more fully developed herein the distance 166 is on the order of five (5) to twenty-five (25) mm. In terms of stitch lengths S (FIG. 5B) the distance 166 should preferably be a minimum of two stitch lengths.

At least that portion of the length of a given finger 130 that extends for the distance 166 past the needle penetration points 146 exhibits a predetermined substantially uniform height dimension 130H. The height dimension 130H of a given finger 130 is measured between the apex of its top surface 130T and its undersurface 130S. In practice, the entire length of the finger, from sinker bar 128 to end 130E, exhibits the height dimension 130H. A uniform height dimension of a finger 130 past the needle penetration points 146 helps to balance the pile yarn feed on each pile loop formed over that finger and prevents pile yarn pull-back as subsequent stitches are formed. In the Figures laterally adjacent fingers have been illustrated as being of equal heights. However, it should be understood that the pile-forming fingers may have varying heights (so long as any given finger meets the uniform height limitation discussed above), whereby pile loops formed over the adjacent fingers creates a pile surface structure with a "high-low" striped effect.

Improved pile coverage is formed when the height 130H of the finger 130 is at least one-half the transverse distance 133 (FIG. 5C) between the centers of adjacent fingers 130. Even better cover is achieved when the height 130H is at least equal to the transverse distance 133. The highest level of coverage is achieved when the height 130H is at least twice the transverse distance 133.

Figure 5D:
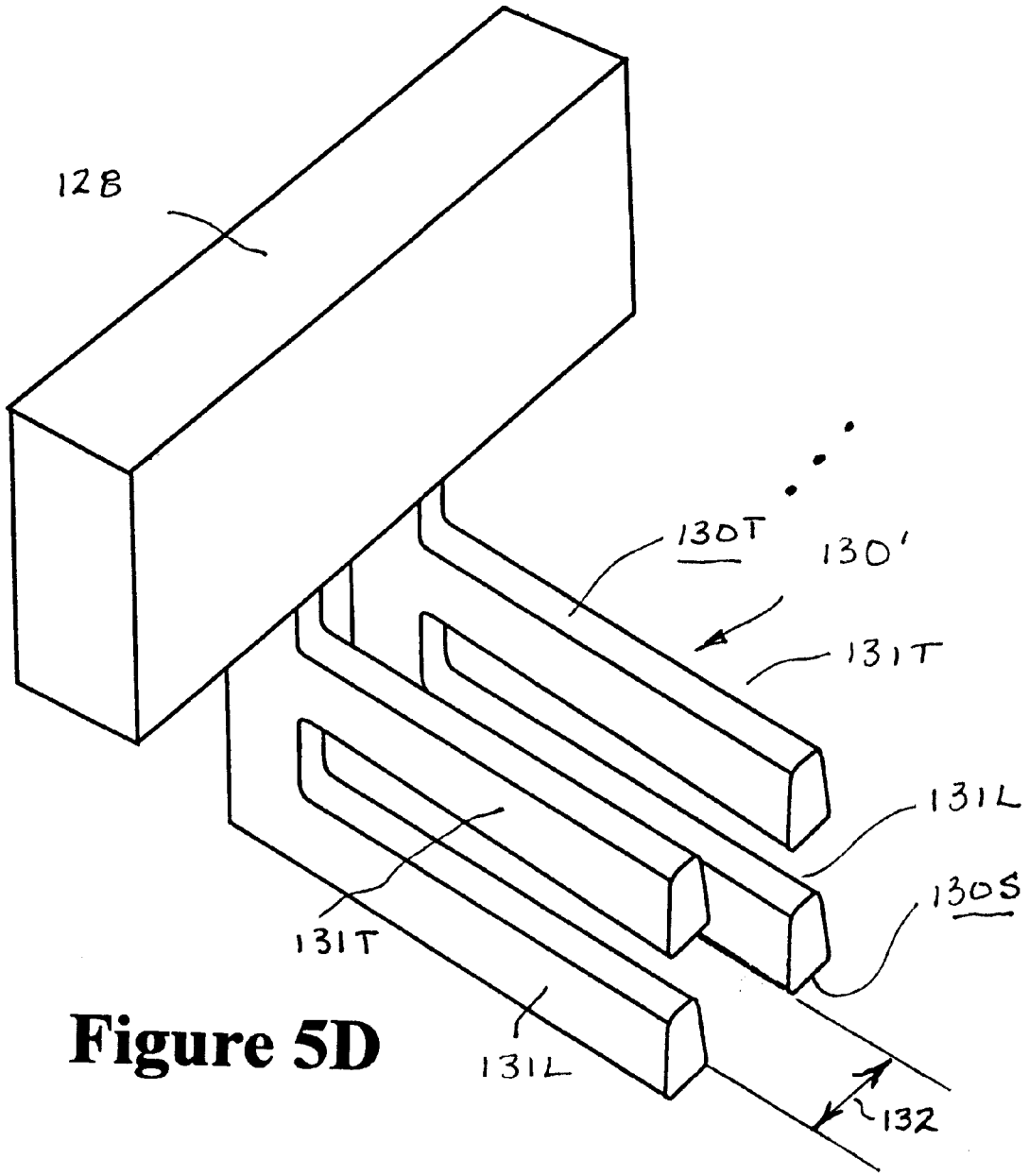
FIG. 5D is a perspective view of an alternate form of sinker finger used in the apparatus in accordance with the present invention.

The preferred form of sinker finger 130 is formed as a solid, uninterrupted member, as illustrated in FIG. 5A. Alternatively, as is shown in FIG. 5D, the sinker finger 130' may be configured as a fork-like structure having an upper tine 131T and a lower tine 131L. The top surface of the upper tine 131T defines the upper surface 130T of the finger 130, while the bottom surface of the lower tine 131L defines the undersurface 130S of the sinker finger 130. The tines may be vertically adjustable. For example the lower tine 131L may be fixed and the upper tine 131T vertically moveable to adjust the height of the pile formed.

The operation of the stitching apparatus 110 is substantially identical to the operation of the apparatus 10 (FIG. 1A). The backing 114 is introduced into the throat 134 defined between the platen 120 and the undersurface 130S of the sinker fingers 130. Again, the bottom surface 114B of the backing 114 is supported on the platen 120 while the top surface 114S is presented to the undersurface 130S of the sinker fingers 130. However, in accordance with the present invention, the dimension 134T of the throat 134 is sized to be substantially equal to the thickness dimension T of the backing 112. The backing 114 is relatively closely confined between undersurface 130S of the sinker fingers 130 and the platen 120 as the backing 114 is advanced in the machine direction 124 through the stitching apparatus 110. As a result the backing is held in place at a set distance (equal to the height 130H) from the top of the sinker fingers, thereby to control the height of the pile loop elements. Such close confinement avoids vertical displacement of the backing 114 as it is reciprocally penetrated by the needles, thus avoiding the loosening of chain stitch underlaps. Owing to the extent of the sinker fingers 130 in the machine direction 124 past the needle penetration points 146, relatively close confinement of the backing 112 between the surface 130S and the surface 120S of the platen 120 continues as the backing 114 is advanced though the stitching apparatus 110.

Stitching threads 148T from adjacent first and second thread guides 152 on the thread guide bar 150T are successively looped around respective first and second locations on a length of pile yarn 148Y dispensed from the guide 152 on the yarn guide bar 150Y, in a manner similar to the action as earlier described in connection with FIG. 1A. However, similar to the situation depicted in FIG. 3A, owing to the extension of the elevated sinker fingers 130 forwardly past needle penetration points 146 (for the distance 166), as adjacent first and second needles respectively engage the looped first and second stitching threads and draw these threads downwardly toward the backing 114, the pile yarn 148Y becomes trained over the surface 130T of the sinker finger 130, thereby forming a laid-in pile yarn element 154 overlying above the first surface 114 of the backing 112. A reciprocating 0-0/2-2 motion of the guide bar may be used.

Similar to the apparatus of FIG. 1A, "Laid Atlas" stitches using 0-0/2-2/2-2/4-4/4-4/6-6/6-6/4-4/4-4/2-2/2-2/0-0 motions, or stitches with even wider transverse movements, such as 0-0/3-3, repeating or propagating in various "Atlas" patterns, may also be used to create various patterns or surface effects.

The formation of the plural rows of pile elements 154, the formation of chain stitches 156 having underlaps 156U holding transverse ends of the laid-in pile yarn elements 154, the formation of longitudinally extending overlap portions 156L on the bottom surface 114B of the backing 114, and the formation of longitudinally extending parallel lines 158 of chain stitches 156 with the stitch spacing ("wale") W, are also all identical to the corresponding operations described in connection with the apparatus of FIG. 1A.

As is best illustrated in the side and front elevational views of FIGS. 5B and 5C the pile yarn element 154 so produced has the form of a pile loop that overlies the top surface 114S between a first generally U-shaped root portion 160-1 located in a first longitudinally extending stitch line 158-1 and a second generally U-shaped root portion 160-2 located in a second longitudinally extending stitch line 158-2. Each root portion 160 is held against the top surface 114S of the backing 114 by the underlap portion 156U of one of the stitches 156. The inverted loop portion 160L of the pile yarn element 154 stands substantially erectly over the surface 114S. The loop portion 160L extends above the top surface 114S of the backing 114 for a predetermined erect pile height distance H. The pile height distance H is measured between the top surface 114S of the backing 114 and the inside surface of the loop portion 160L of the pile yarn element 154.

Owing to the very close lateral spacing 132 between adjacent fingers 130, deflection of the backing 114 during the upward stroke of the needle 146 is held to a minimum. In addition, the substantially uniform height dimension 130H of the fingers 130 (for at least the distance 166 past the needle penetration points 146) prevents pull-back of the pile element as subsequent stitches are formed. These two considerations, coupled with fact that the dimension 134T of the throat 134 is substantially equal to the thickness dimension T of the backing 114, result in a looped pile element 154 having a height dimension H that is substantially equal to the height dimension 130H of the sinker fingers 130. Typically the height dimension H of the loop pile element 154 is on the order of one to twenty (1–20) millimeters. In a pile surface structure 112 formed in accordance with the present invention the ratio of the predetermined pile height H to the predetermined stitch spacing W preferably satisfies the relationship:

$$H/W>0.5 \quad (1).$$

As noted earlier each stitch 156 includes an underlap portion 156U that extends over the top surface 114T of the backing 114 and a looped overlap portion 156L that extends over the bottom surface 114B of the backing 114. The overlap portions 156L interlink, chain fashion, with the loop of the previous stitch. A stitch 156 in the form of a closed 1-0/1-0 chain stitch is preferred, although other stitches, such as an open 1-0/0-1 stitch, can be used.

Recognizing that the backing 114 has a thickness dimension T, the pile yarn 148Y (whether single or multi-ended) has a diameter (or effective diameter) D, and the overlap portion 156L has a predetermined length dimension substantially equal to the stitch length S, it may be appreciated from FIG. 5B that all or substantially all of the stitches 156 have a theoretical thread deknit length DKL given by the relationship:

$$DKL<=D\cdot(1+\Pi/2)+(2\cdot T)+(2\cdot S) \quad (2)$$

The theoretical thread deknit length DKL represents the length of stitching thread utilized to form a given stitch 156. If that stitch were unraveled the maximum length of thread used in that stitch would be given by Equation (2).

The last term [(2·S)] of the theoretical thread deknit length Equation (2) represents the length of the chain stitch overlaps 156L. Because of interlooping between longitudinally adjacent overlaps, the actual length is slightly longer than the length expression used in Equation (2). The middle term [(2·T) ] of Equation (2) represents the length of thread segments entering and leaving the backing. These segments are usually small and difficult to change since most backings are relatively thin and incompressible.

The first term [D·(1+Π/2)] of the theoretical thread deknit length Equation (2) represents the length of the chain stitch underlaps 156U holding the U-shaped root portions of the pile yarn elements to the backing 114. As will be discussed, this length can be reduced by either applying higher tensions to the thread during stitching, by shrinking the thread after stitching, or by stitching the backing and causing some of the thread length of the underlaps to be pulled tighter.

To reduce the first term [D·(1+Π/2)] of Equation (2) and tighten the underlaps so that the pile yarn in the root portions of the pile elements is compressed to approximately half of its diameter, it was estimated that DKL should be reduced by about ten (10%) percent. Accordingly, more preferably, in accordance with the present invention the theoretical thread deknit length DKL for all or substantially all of the stitches 156 is given by the relationship:

$$DKL<=0.9\cdot[D\cdot(1+\Pi/2)+(2\cdot T)+(2\cdot S)] \quad (2A)$$

Even more preferably the theoretical thread deknit length DKL for all or substantially all of the stitches 156 is given by the relationship:

$$DKL<=0.8\cdot[D\cdot(1+\Pi/2)+(2\cdot T)+(2\cdot S)] \quad (2B)$$

The theoretical thread deknit length DKL given by the Equation (2B) corresponds to a reduction of pile yarn diameter to approximately one-fifth of its basic diameter (or effective diameter) D. In most cases such a reduction corresponds to a yarn which is compressed to such an extent that the filaments forming the yarn are nearly solidified when viewed in cross section.

In practice, the actual thread length is automatically recorded in terms of "runners". A "runner" is the length of thread consumed in forming four hundred eighty (480) stitches. The actual DKL for each stitch formed may be calculated (runner thread length/480) and compared to the theoretical value given by Equations (2A), (2B), or (2C).

A pile surface structure 112 in accordance with the present invention, having stitches 156 with a deknit length DKL that is smaller than the value given by Equation (2), is defined as a "tight" structure. That is to say, the underlaps 156U of the stitches 156 holding the looped pile yarn element 154 to the backing would, in the root portion 160 of the element, constrict or squeeze the pile yarn into tight contact with the backing 114. The constriction, or squeezing, of the yarn by the underlap 156U forms distended regions 154D in the root portion 160 of the pile element 154.

—o—0—o—

It lies within the contemplation of the present invention that the pile surface structure 112 having looped pile elements 154 as hereinbefore described, whether alternatively or additionally modified in any of the manner(s) discussed herein, may alternatively be implemented to create a cut pile surface structure.

In general, the cut pile surface structure is produced by cutting the loop pile element 154 near the apex of the loop 160L. Cutting a pile loop portion 160L of the pile yarn element 154 results in a pair of cut pile elements. Each cut pile element has a generally U-shaped root portion 160 in the vicinity of each underlap 156U of the stitching thread. Each cut pile element 164A, 164B formed by severing a loop pile element has two substantially erect branches extending from the U-shaped root portion 160. Expressed alternatively, a loop pile yarn element 154 as shown in FIGS. 5B, 5C may be considered as the pile structure defined by the integral jointure of one branch of a cut pile element lying in a first stitch line to a branch emanating from a cut pile element disposed in an adjacent stitch row.

Each branch has a height H' measured from the top surface 114S of the backing 114 to a point near the tip of the branch. The cut pile height H' is substantially equal to the height dimension 130H of the sinker fingers 130 used to form the loop pile from which the cut pile elements are produced.

A cut pile structure in accordance with the present invention preferably also satisfies the relationship $$H'/W>0.5 \qquad (1A).$$

The deknit length equations (2A), (2B) or (2C) are also satisfied.

To form the cut pile elements the apparatus 110 is modified to include a suitable cutting implement near the end 130E of each finger 130. The upper surface of the fingers 130 is slit and a cutting blade is received within the slit. In practice the cutting edge of the blade lies on the finger 130 a predetermined close distance (on the order of a one to five millimeters) past the needle-penetration line. As a pile loop advances along the surface of the finger 130 it is severed at its apex while still on the finger. Alternatively, the pile loops may be cut with rotating blades or reciprocating blades placed in the same location as the stationary blades, and attached on to separate devices to engage and cut the loops as the emerge from the surface of the fingers 130.

EXAMPLES

The following examples are only meant for illustration, and not to cover the entire range of the possibilities of this invention.

Example 1

A loop pile carpet-structure was formed on a modified ninety-six inch (96") wide Karl Mayer stitching unit, with the upper fingers and lower fingers arranged as per FIG. 5A. The elevation of the upper six-gage (six per inch) fingers was approximately eight millimeters over the backing. The backing was one hundred percent (100%) polyester Reemay® Style 2033 (100 gms/sq.m.) manufactured by Reemay Inc., Old Hickory, Tenn. The pile yarns were 3700 denier bulked continuous filament (BCF) nylon, manufactured by E. I. du Pont de Nemours and Company ("DuPont"), Wilmington, Del. The pile yarns were fed from a six-gage (six per inch) guide-bar, equipped with wide spoon guides, making a 0-0/2-2 motion. A second six-gage guide bar, placed in front of the first bar, formed a 1-0/1-0 chain stitch between the elevated fingers, using 230 dtex high-tenacity polyester thread. The stitch frequency was at twelve courses per inch, at a speed of seven hundred (700) rpm. The needle bar was equipped with penetrating needles using linear closures. The process successfully formed a pile, approximately seven millimeter high, over the backing, secured by the polyester stitching thread. The total weight of the pile was 625 gms/sq.m., and the total weight of the structure 760 gms/sq.m. Despite the low pile weight the face of the backing was well-covered with the pile yarns, and the pile loops were very stable. When the product was heated to approximately 130° C., pulled in the machine direction, and cooled under tension, a small elongation of ten (10%) percent caused the self-locking chain stitches to tighten, and created a structure that required at least thirteen hundred (1,300) grams to pull an individual loop above the other loops.

Example 2

The process of Example 1 was repeated, with the exception that the back-bar, carrying the 3700 denier yarns, was threaded with alternating colors at every second wale, and the bar had a 0-0/2-2, 2-2/4-4, 4-4/6-6, 6-6/4-4, 4-4/2-2, 2-2/0-0 motion, making an Atlas-type design, with colors alternating at every course. The total product weight, and all other parameters remained approximately the same as in Example 1.

Example 3

The process and product of Example 1 was repeated, with the exception that a layer of nonwoven polypropylene 3.8 ounce/yard or 130 grams/sq.m.) was introduced over the original Reemay® backing. The layer of nonwoven polypropylene was that sold by DuPont under the trademark TYPAR®. The total weight of the stitched structure was measured at 887 grams/sq.m. The pile weight was calculated from the yarn consumption (the runner record) to be 453 grams/sq.m. Face coverage was excellent.

Example 4

The process and product of Example 3 was repeated, with the additional feature of a weft-inserted 840 denier high-tenacity polyester yarn attached to the system at the same longitudinal frequency as the stitches. The total product weight increased to 760 grams/sq.m. with the pile fibers at 485 grams/sq.m. All properties were approximately the same as Example 3, except that the finished pile surface structure was somewhat stiffer and much stronger in the cross-direction.

—o—0—o—

Those skilled in the art, having the teachings of the present invention as hereinabove set forth, may impart numerous modifications thereto. Such modifications are to be construed as lying within the contemplation of the present invention, as defined by the appended claims.

What is claimed is:

1. In a stitching apparatus having a plurality of transversely spaced needles forming a needle array, each needle having a predetermined width dimension (142D), the needles in operation being movable to penetrate a backing at a plurality of needle penetration points as the backing is conveyed along a path of travel through the apparatus, a plurality of laterally adjacent sinker fingers extending forwardly in the direction of travel, each needle being disposed laterally intermediate adjacent fingers, each finger having a forward end thereon, wherein the improvement comprises:

the sinker fingers extending forwardly in the direction of travel past the needle penetration points, the height dimension of at least that portion of each finger that extends forwardly past the needle penetration points being substantially uniform, the fingers have a base region, adjacent fingers being spaced from each other by a lateral spacing distance (132) not greater than 1.5 times the predetermined width dimension (142D) of the needle intermediate therebetween.

2. The stitching apparatus of claim 1 wherein each finger is a fork-like structure having an upper tine and a lower tine.

3. The stitching apparatus of claim 2 wherein the lateral spacing distance (132) not greater than 1.3 times the predetermined width dimension (142D) of the needle intermediate therebetween.

4. The stitching apparatus of claim 1 wherein the lateral spacing distance (132) not greater than 1.3 times the predetermined width dimension (142D) of the needle intermediate therebetween.

5. The stitching apparatus of claim 4 wherein the height of the sinker fingers is at least one-half the distance between the centers of adjacent fingers.

6. The stitching apparatus of claim 2 wherein the height of the sinker fingers is at least one-half the distance between the centers of adjacent fingers.

7. The stitching apparatus of claim 1 wherein the height of the sinker fingers is at least one-half the distance between the centers of adjacent fingers.

8. The stitching apparatus of claim 4 wherein the height of the sinker fingers is at least equal to the distance between the centers of adjacent fingers.

9. The stitching apparatus of claim 2 wherein the height of the sinker fingers is at least equal to the distance between the centers of adjacent fingers.

10. The stitching apparatus of claim 1 wherein the height of the sinker fingers is at least equal to the distance between the centers of adjacent fingers.

11. The stitching apparatus of claim 4 wherein the height of the sinker fingers is at least equal to twice the distance between the centers of adjacent fingers.

12. The stitching apparatus of claim 2 wherein the height of the sinker fingers is at least equal to twice the distance between the centers of adjacent fingers.

13. The stitching apparatus of claim 1 wherein the height of the sinker fingers is at least equal to twice the distance between the centers of adjacent fingers.

* * * * *